US005699914A

United States Patent [19]

Broersma

[11] Patent Number: 5,699,914

[45] Date of Patent: Dec. 23, 1997

[54] NESTABLE CONTAINER

[75] Inventor: Rogier Broersma, Bergen, Netherlands

[73] Assignee: Diafer B.V., Bergen, Netherlands

[21] Appl. No.: 776,156

[22] PCT Filed: Jul. 19, 1995

[86] PCT No.: PCT/NL95/00253

§ 371 Date: Jan. 27, 1997

§ 102(e) Date: Jan. 27, 1997

[87] PCT Pub. No.: WO96/03323

PCT Pub. Date: Feb. 8, 1996

[30] Foreign Application Priority Data

Jul. 26, 1994 [NL] Netherlands ..... 9401221

[51] Int. Cl.[6] ..... B65D 19/18

[52] U.S. Cl. ..... 206/517; 206/518; 220/4.24

[58] Field of Search ..... 206/515, 517, 206/518; 220/4.24, 4.26

[56] References Cited

U.S. PATENT DOCUMENTS 769,915 9/1904 Nostrand ..... 206/517

2,950,029 8/1960 Winstgad ..... 206/517

2,961,123 11/1960 Boydak et al. ..... 206/517

3,275,188 9/1966 Wilson .

FOREIGN PATENT DOCUMENTS 1470759 2/1967 France .

7 301 064 8/1973 Netherlands .

*Primary Examiner*—Joseph M. Moy

*Attorney, Agent, or Firm*—Young & Thompson

[57] ABSTRACT

A nestable container comprises a base which comprises two base halves joined along a hinge line, as well as walls which are upright with respect to the base and in which breaks are provided in such a way that the container halves defined by the base halves are hingeable with respect to one another between a closed position and an open position in which the container is nestable. The hinge line runs obliquely with respect to at least one of the walls.

15 Claims, 5 Drawing Sheets

NESTABLE CONTAINER

The invention relates to a nestable container comprising a base which comprises two base halves joined along a hinge line, as well as walls which are upright with respect to the base and in which breaks are provided in such a way that the container halves defined by the base halves are hingeable with respect to one another between a closed position and an open position in which the container is nestable.

A container of this type is disclosed in NL-A-7 301 064. Said known container is constructed in the form of a crate consisting of two halves which are joined by means of a hinge which runs perpendicular to two opposite walls. In the closed position, the crate is stackable, in such a way that the contents thereof are also well protected when the crate is stacked.

In the closed position of the crate, the walls of said crate which run parallel to the hinge form a support for a crate stacked thereon. When the crate halves are hinged apart into their open position, said walls move apart, in such a way that the crate is nestable in said position. However, the criterion for good nestability is that the other two walls, which run perpendicular to the hinge line, move apart obliquely with respect to the base of the crate.

The disadvantage of the latter two walls having said fixed position, from which they move apart, even when the crate is in the closed position, is that said walls are not able to make any contribution towards supporting a crate stacked thereon. As a result, the other two walls bear a relatively heavy load, whilst the stability of a stack of crates of this type is limited.

Furthermore, the consequence of the walls which run perpendicular to the hinge being permanently in a position in which they move apart is that the capacity of the crate is relatively small for given external dimensions.

The aim of the invention is, therefore, to provide a container of the type mentioned above which does not have these disadvantages. Said aim is achieved in that the hinge line runs obliquely with respect to at least one of the walls.

The consequence of the particular orientation of the hinge line according to the invention is that when the container halves are hinged towards the open position the opposing walls start to move apart. This results in the advantage, that the container is readily nestable in the open position, whilst in the closed position all walls are still able to make a contribution towards supporting a container stacked thereon. It is self-evident that the rigidity and stability of a stack formed of the containers according to the invention are outstanding. Furthermore, the nestability is such that a stack of empty containers can be reduced to a small package.

A further advantage of the container according to the invention is that all walls can be perpendicular to the associated half of the base. The consequence of this is that the capacity of a container of this type can be relatively large for given external dimensions. Moreover, the strength of said walls, in particular with regard to buckling, is greater than that of the known containers.

With the known container, the breaks in the walls are located in line with the hinge line. This can also be the case for the container according to the invention. However, it is also possible to choose to have only one break in line with the hinge line and the other break elsewhere.

In the latter case, one of the container halves has a wall section which protrudes with respect to the associated half of the base, and the other container half has a wall section which is set back.

Needless to say, it is also possible for both breaks to be located in a position other than in line with the hinge line.

In the closed position of the container, all walls can abut one another with the formation of an unbroken periphery.

The base of the container according to the invention can have all sorts of different shapes. For instance, it can be constructed as a polygon. However, to ensure good nestability a condition which must be met is that, for each container half, the sum of the opposing angles between the hinge line and the two walls intersecting or crossing said hinge line is less than 180°.

In a preferred embodiment, the base is rectangular or square and the hinge line runs essentially diagonally with respect to the base.

With an embodiment of this type, the containers can be nested very efficiently. Container production is also simple. The container halves now each consist of a half base with a wall only on the two mutually perpendicular sides. Container halves of this type release naturally, so that they are very suitable for production by means of injection moulding. Nevertheless, the container can also be produced as a whole if a film hinge is present between the base halves.

Very good nestability is obtained if the ratio of the thicknesses of two intersecting walls is proportional to the ratio of their lengths.

In order to increase the strength and rigidity of the container in the closed state, the walls or wall sections located on either side of a break can be provided, at their ends facing one another, with protrusions and recesses which interact when the container is in the closed state. Protrusions and recesses of this type prevent the walls sliding along one another, which, in particular, has an advantageous effect on the torsional rigidity of the closed container.

The walls or wall sections located on either side of a break can be provided with fixing means which can be made to interact with one another.

The base halves can also be provided, on the faces which face one another, with protrusions and recesses which interact when the container is in the closed state.

In a certain embodiment of the container, it can be desirable to provide axial play for the hinge joining the base halves. This embodiment is advantageous in particular in the case of containers with walls which do not have the above-mentioned thickness ratio. Specifically, if such a thickness ratio is lacking, the walls no longer abut well and, on nesting, mutual torsion can arise between the successive containers about an axis in the nesting or stacking direction. This twisting can be corrected by virtue of the axial play in the hinge.

A further advantage of the container according to the invention is that at least the insides of all walls are directed perpendicularly to the associated base half. As e result, a maximum usable capacity is ensured for giver external dimensions of the container.

The invention also relates to a system comprising at least one container according to one of the above embodiments as well as a support element for supporting a container in the open position, which support element comprises a foot and bearing means which extend upwards with respect to the foot and the top of which is located at a distance above the foot which is smaller than the maximum distance between a corner and the hinge, in such a way that the container can be supported at the location of the hinge line on the bearing means and, by means of the corners of the base located some distance away from the hinge line, can be supported on the foot or a support surface corresponding thereto.

The container according to the invention can be combined with conventional, one-piece containers of the same dimensions. Thus, the stackability of the container according to the invention is equal to that of the conventional containers; the stack can be supported on all four walls. Introduction of the container according to the invention can consequently take place gradually. This is attractive from the investment standpoint, since it is not necessary to replace all containers at once.

It is pointed out that containers of different heights can be stacked and nested with the various sizes in any order.

The containers in the open position are self-seeking, which is a major advantage when forming stacks of nested containers.

An illustrative embodiment of the container according to the invention will be described in more detail below with reference to the figures.

Figure 1:
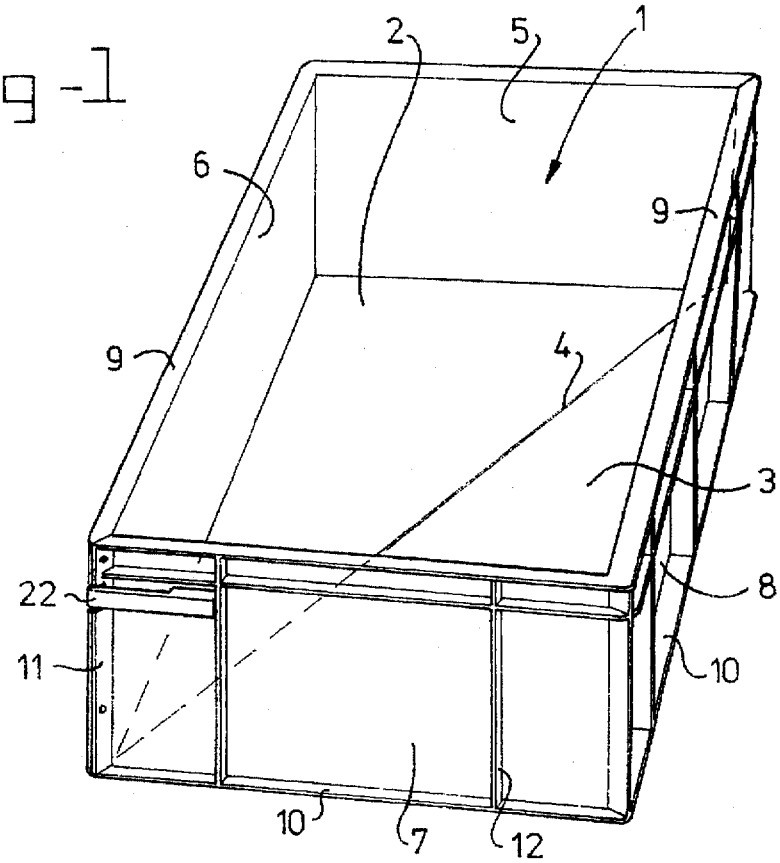
FIG. 1 shows a perspective view of a container according to the invention which is constructed as a crate, in the closed position.

The container shown in FIG. 1 can be a crate of the desired standard dimensions. However, the containers concerned can also be crates which are used as standard containers in auctions, and the like.

The crate comprises a rectangular base 1, consisting of two base halves 2, 3, which are hingeably joined to one another via hinge line 4. The upright walls 5, 6 are joined to base half 2. The upright walls 7–8 are joined to base half 3.

As shown in FIG. 1, the hinge line runs on one side through the inner corner defined between the walls 6 and 7 and, on the other side, through the inner corner defined by the walls 5 and 8.

Said walls 5 to 8 are smooth on the inside, and on the outside can be provided, in the conventional manner, with horizontal reinforcing ribs 9 and 10, as well as vertical reinforcing ribs 11 and 12.

Figure 2:
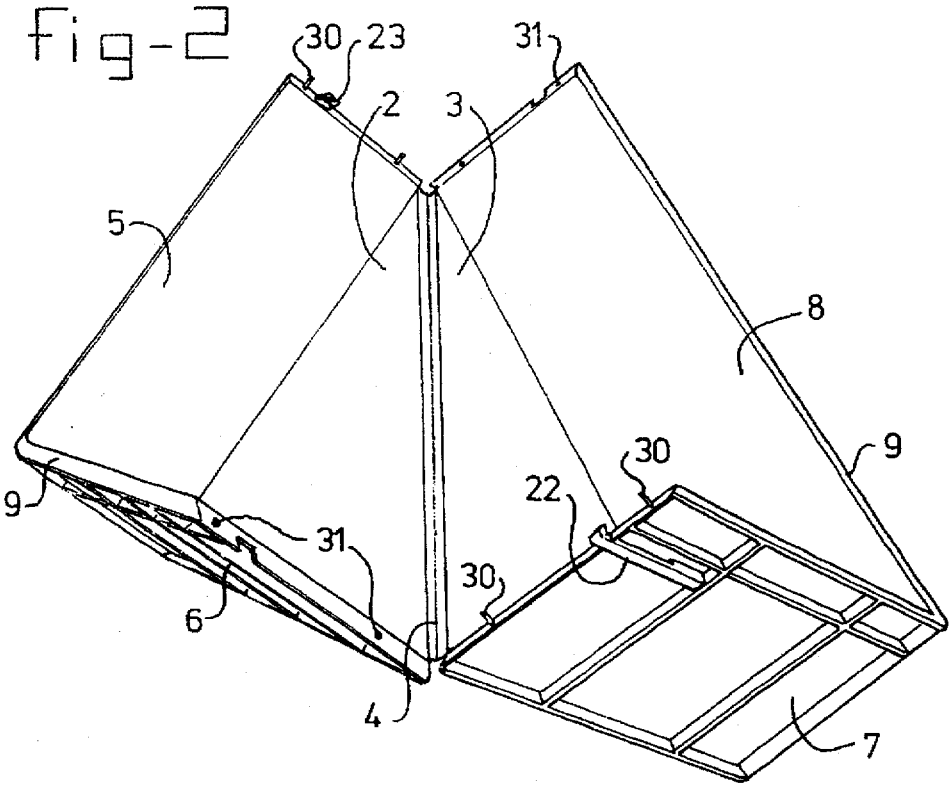
FIG. 2 shows a perspective view of the crate in FIG. 1, in the open position.
Figure 4:
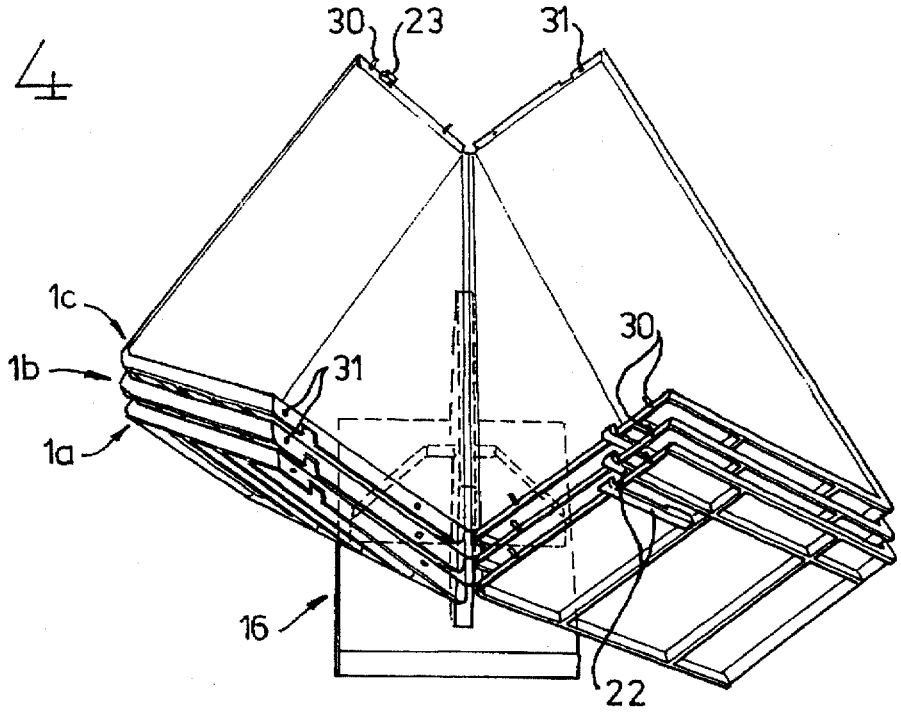
FIG. 4 shows the support element with three crates in the open, nested position.

As is shown in FIG. 2, the hinge line 4 is located at the height of the bottom surface of the base 1, as made up of the base halves 2 and 3. In the opened position of the container, all four walls 5 to 8 are directed towards the outside, in such a way that, when the container is opened in this way, another container which has been hinged into the same position can be nested without any problems. T he various features are shown in FIG. 4, in which three containers 1*a* to 1*c* are nested in one another. This nestability can even be obtained if the walls 5, 6 and 7, 8 are each perpendicular to their associated base half 2 or 3. This is because, in the opened position of the container, said walls 5 to 8 all assume a position such that the nesting of a subsequent container therein is possible without any problems.

Figure 5:
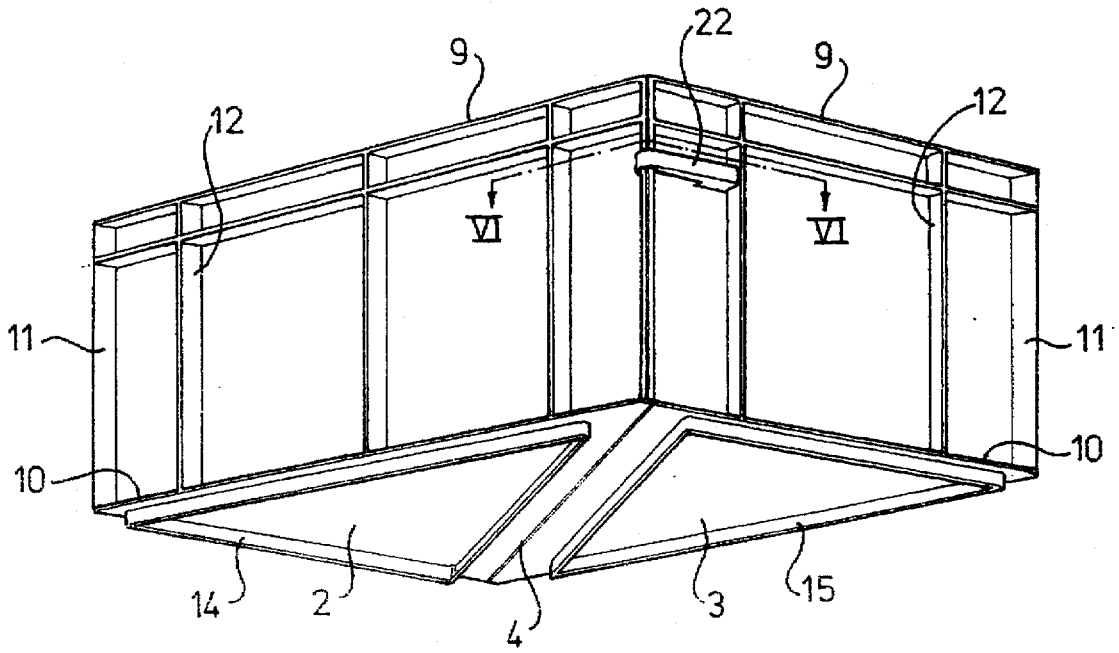
FIG. 5 shows a perspective view of the crate from below.

In the closed position of the container, the upper ribs 9 of all four walls additionally form a protruding support for a wall stacked thereon. With this arrangement, the lower ribs 10 come to rest on the upper ribs 9. As shown in FIG. 5, each of the base halves 2, 3 has a set 14 and 15, respectively, of three ribs which are directed downwards and each form a right-angled triangle. The outer periphery determined by said ribs 14, 15 can be accommodated between the walls 5 to 8 of a container located beneath it, as a result of which a very stable and firm stack is ensured.

It can also be seen from the figures that the edges of the walls which face one another have, on one side, recesses 31 and, on the other side, protrusions 30. In the closed position of the container, the interacting recesses and protrusions provide the desired rigidity and strength, for example against mutual sliding movements of the walls.

The walls are held against one another by means of the arms 22, as will be explained with reference to FIGS. 5 and 6.

Figure 3:
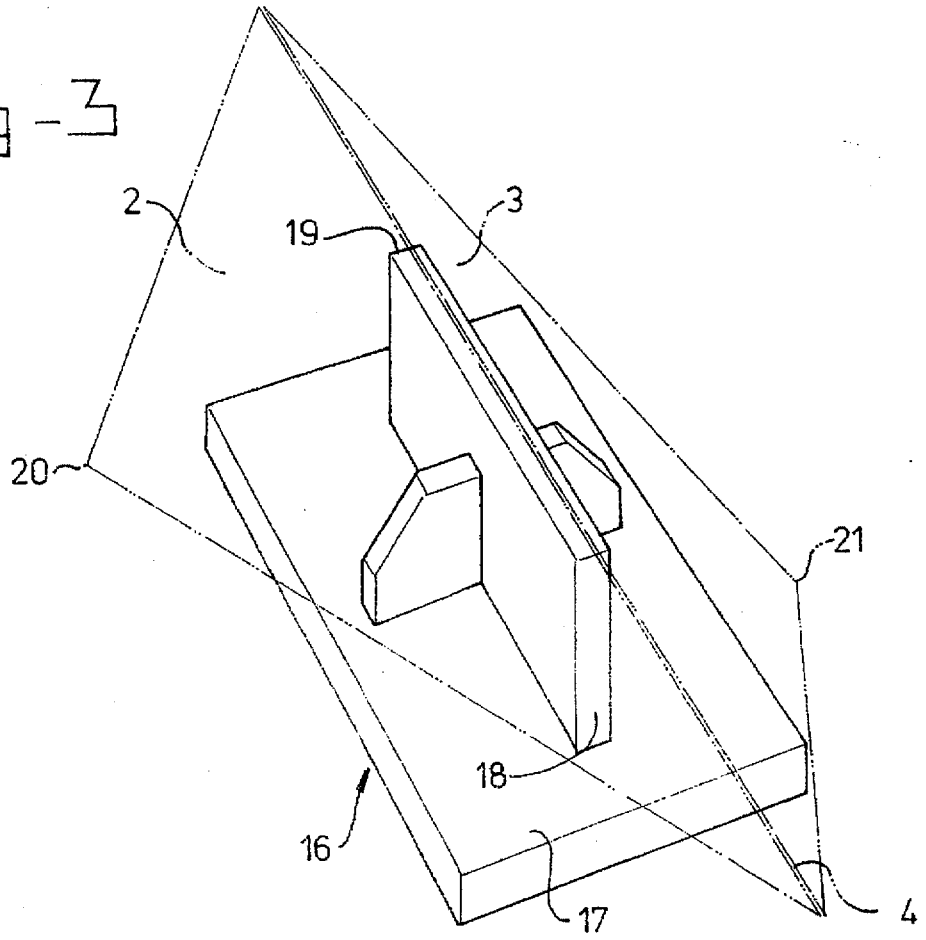
FIG. 3 shows a perspective view of a support element for a crate according to the invention.

FIG. 3 shows a support element which is indicated in its entirety by 16 and comprises a foot 17 as well as bearing means 18, which extend upwards with respect to said foot. The top edge 19 of the bearing means 18 extends above the foot 17 to such a height that the base halves 2, 3 (shown diagrammatically) of a crate rest with their respective corners 20, 21 precisely on a surface supporting the foot 17 when the hinge line 4 is located in the plane of the bearing means 18.

As is shown in FIG. 4, very good nestability can be obtained with the containers in this position.

It is pointed out that the containers can be nested in any arbitrary position as long as they are in the open position. It is conceivable, for example, to support a container on one of its walls 5 to 8 and then to fold it open in such a way that the other containers can be nested. The containers can also be upside down.

Figure 6:
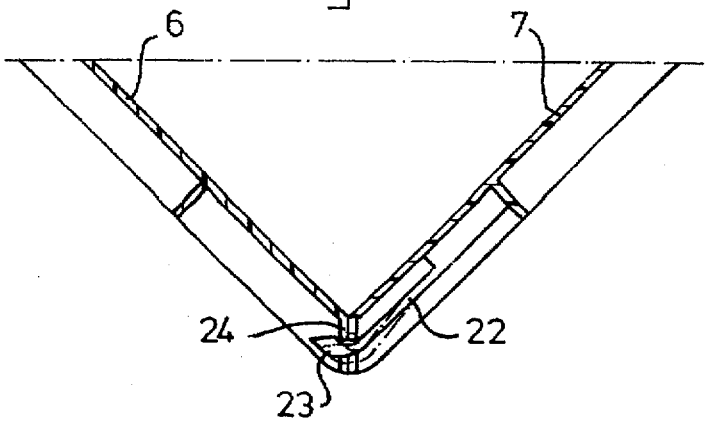
FIG. 6 shows a closing mechanism, according to view VI—VI in FIG. 5.

FIGS. 5 and 6 show a resilient arm 22, which is attached to wall 7. Said arm 22 has a barbed head 23, which can be hooked behind the corner rib 24 of wall 6. The connection between the walls automatically comes into effect when the crate is closed.

Figure 7:
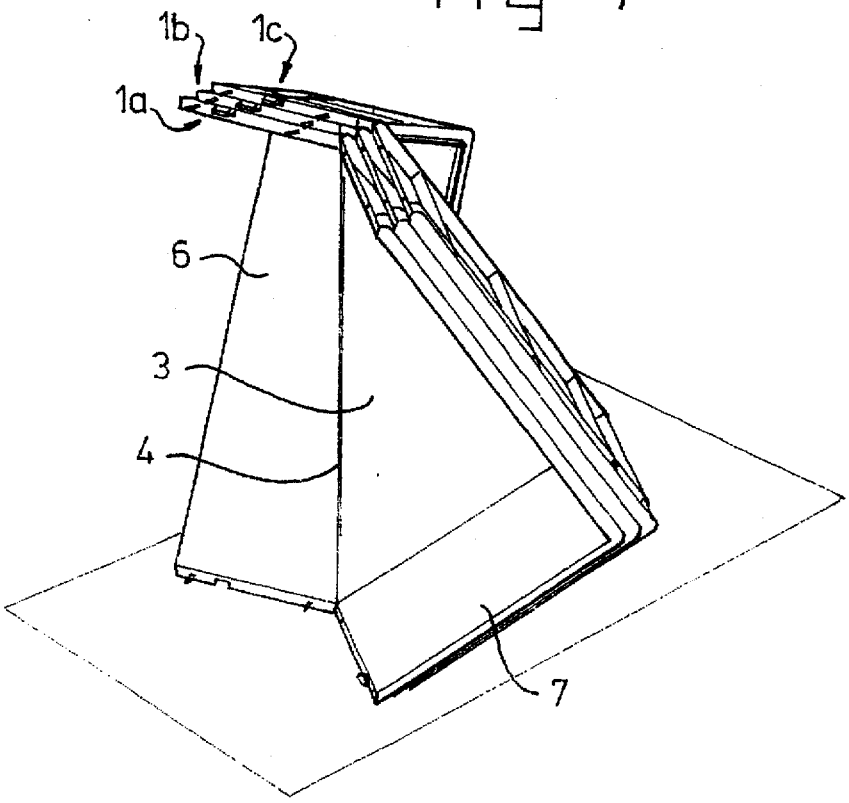
FIG. 7 shows a stack placed on its side.

It can be seen in FIG. 7 that the containers 1*a*–1*c* can also be placed on their side. The faces determined by said side are completely flat, as a result of which a flat boundary is obtained.

Figure 8:
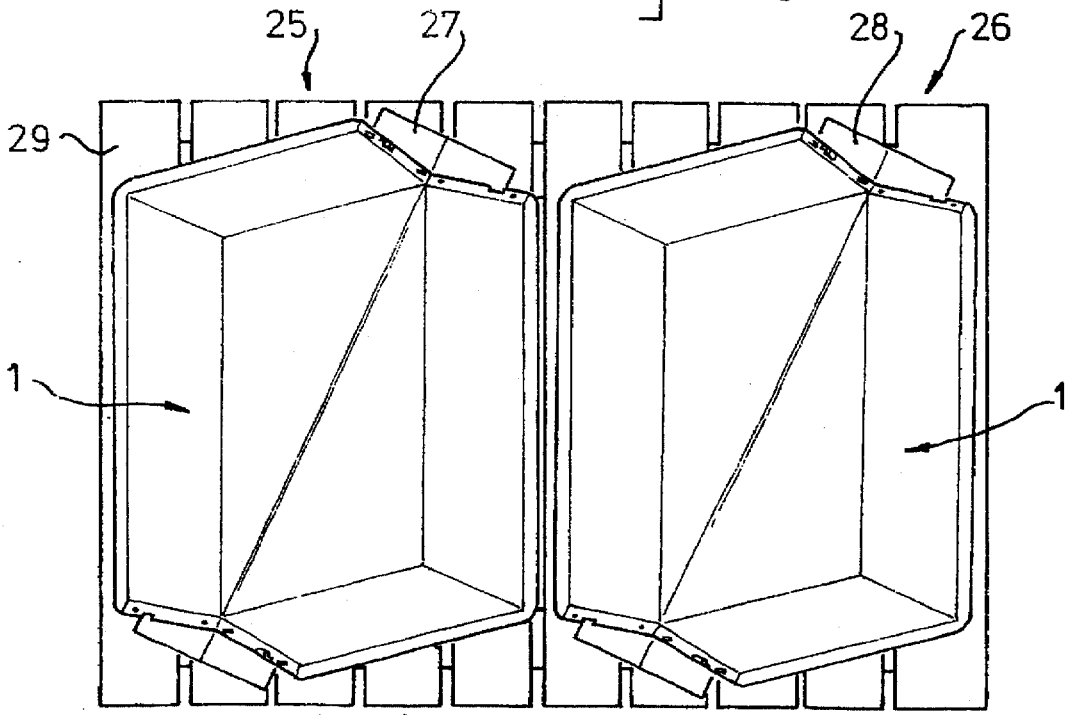
FIG. 8 shows a top view of two stacks on a pallet.

FIG. 8 shows that two stacks 25, 26 can be placed on a standard pallet 29 provided with support elements 27, 28.

Figure 9:
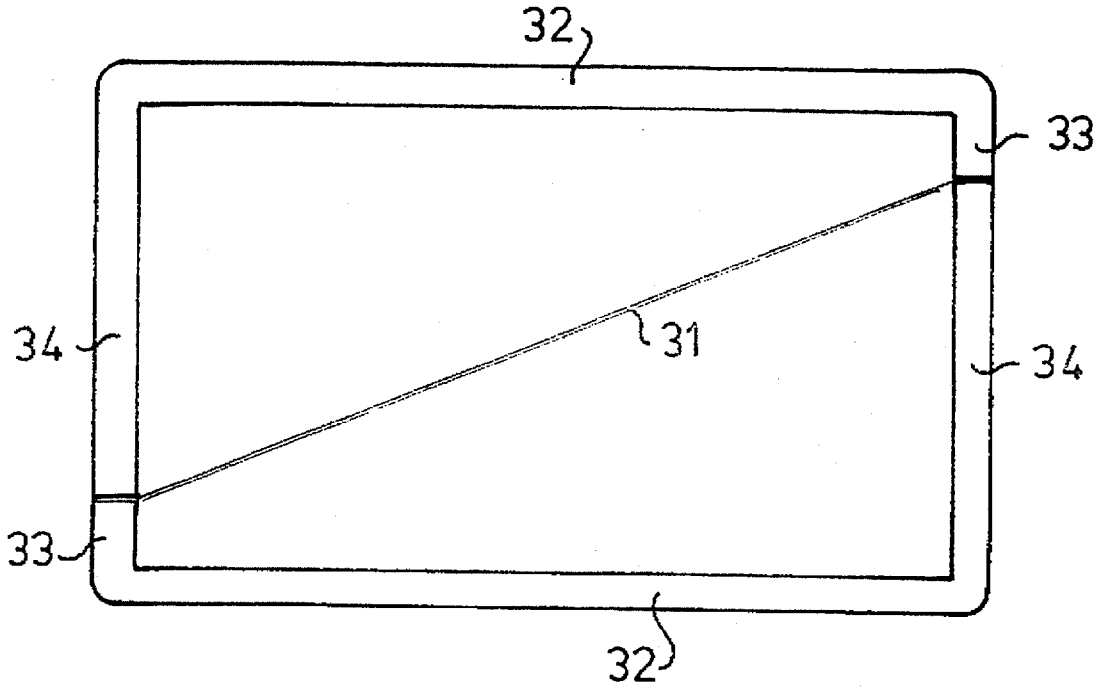
FIG. 9 shows a top view of a variant of the container.

The variant of the container shown in FIG. 9 has a hinge 31 which does not run through the inner corners of the walls. In this embodiment the longitudinal walls 32 are delimited at both ends by, respectively, a short section 33 and a long section 34 of transverse wall. What is achieved by this means is, on the one hand, that the longitudinal walls 32 and transverse walls 33, 34 can have equal thicknesses, such that a container of this type is readily stackable on the known one-piece containers. On the other hand, the ratio between the length of side wall sections 33, 34 and the thickness of side wall sections 33, 34 can be chosen such that said ratio is proportional to the length of said walls. By this means it is possible, despite the fact that all walls have the same thickness, nevertheless to achieve a situation in which the folded-open containers can be nested without twisting occurring about a line in the stacking direction.

I claim:

1. Nestable container comprising a base (1) which comprises two base halves (2, 3) joined along a hinge line (4), as well as walls (5–8) which are upright with respect to the base (1) and in which breaks are provided in such a way that the container halves defined by the base halves (2, 3) are hingeable with respect to one another between a closed position and an open position in which the container is nestable, characterised in that the hinge line (4) runs obliquely with respect to at least one of the walls (5–8).

2. Container according to claim 1, wherein at least one of the breaks in the container walls is located in line with the hinge line (4).

3. Container according to claim 1, wherein at least one of the breaks is located in a position other than in line with the hinge line (4), in such a way that one of the container halves has a wall section which protrudes with respect to the associated half of the base, and the other container half has a wall section which is set back.

4. Container according to claim 1, wherein in the closed position all walls abut one another with the formation of an unbroken periphery.

5. Container according to claim 1, wherein the base is a polygon and, for each container half, the sum of the opposing angles between the hinge line and the two walls intersecting or crossing said hinge line is less than 180°.

6. Container according to claim 1, wherein the base is rectangular or square and the hinge line (4) runs essentially diagonally with respect to the base.

7. Container according to claim 6, wherein the hinge line (4) runs through two inner corners of the container which are located diagonally opposite one another.

8. Container according to claim 7, wherein the ratio of the thicknesses of two intersecting walls (5, 8; 6, 7) is proportional to the ratio of their lengths.

9. Container according to claim 8, wherein at least one of the walls has, on its inner surface, a recess which is located between the ends of said surface.

10. Container according to claim 1, wherein the walls or wall sections located on either side of a break are provided, at their ends facing one another, with protrusions (30) and recesses (31) which interact when the container is in the closed state.

11. Container according to claim 1, wherein the walls or wall sections located on either side of a break are provided with fixing means (22, 23, 24) which can be made to interact with one another.

12. Container according to claim 1, wherein the base halves are provided, on the faces which face one another, with protrusions and recesses which interact when the container is in the closed state.

13. Container according to claim 1, wherein the hinge (4) connecting the base halves has a limited axial play.

14. Container according to claim 1, wherein at least the insides of all walls are perpendicular to the associated base half.

15. System comprising at least one container according to claim 1 as well as a support element (16) for supporting a container in the open position, which support element (16) comprises a foot (17) and bearing means (18) which extend upwards with respect to the foot (17) and the top (19) of which is located at a distance above the foot (17) which is smaller than the maximum distance between a corner and the hinge line (4), in such a way that the container can be supported at the height of the hinge line (4) on the bearing means (18) and, by means of the corners (20, 21) of the base located some distance away from the hinge line (4), can be supported on the foot (17) or a support surface corresponding thereto.

* * * * *